US010163345B2

(12) United States Patent
Nusser et al.

(10) Patent No.: US 10,163,345 B2
(45) Date of Patent: Dec. 25, 2018

(54) METHOD AND DEVICE FOR PROVIDING AN EVENT MESSAGE INDICATIVE OF AN IMMINENT EVENT FOR A VEHICLE

(71) Applicant: Robert Bosch GmbH, Stuttgart (DE)

(72) Inventors: Sebastian Nusser, Hildesheim (DE); Heinz-Werner Pfeiffer, Hohenhameln (DE)

(73) Assignee: ROBERT BOSCH GMBH, Stuttgart (DE)

( * ) Notice: Subject to any disclaimer, the term of this patent is extended or adjusted under 35 U.S.C. 154(b) by 33 days.

(21) Appl. No.: 15/032,774

(22) PCT Filed: Oct. 6, 2014

(86) PCT No.: PCT/EP2014/071331
§ 371 (c)(1),
(2) Date: Apr. 28, 2016

(87) PCT Pub. No.: WO2015/062816
PCT Pub. Date: May 7, 2015

(65) Prior Publication Data

US 2016/0267792 A1 Sep. 15, 2016

(30) Foreign Application Priority Data

Oct. 30, 2013 (DE) ..... 10 2013 222 020

(51) Int. Cl.
*G08G 1/09* (2006.01)
*G08G 1/0968* (2006.01)
*G08G 1/0967* (2006.01)

(52) U.S. Cl.
CPC . *G08G 1/096861* (2013.01); *G08G 1/096741* (2013.01); *G08G 1/096775* (2013.01)

(58) Field of Classification Search
CPC ..... G08G 1/096861; G08G 1/096741; G08G 1/096775
(Continued)

(56) References Cited

U.S. PATENT DOCUMENTS 7,406,199 B2 * 7/2008 Lindeman ..... G06K 9/00 348/113
8,370,106 B2 * 2/2013 Shkolnikov ..... G06F 1/1626 702/150
(Continued)

FOREIGN PATENT DOCUMENTS

WO WO2013/132031 9/2013

OTHER PUBLICATIONS

International Search Report for PCT/EP2014/071331, dated Feb. 24, 2015.

*Primary Examiner* — Omar Casillashernandez
(74) *Attorney, Agent, or Firm* — Norton Rose Fulbright US LLP; Gerard Messina

(57) ABSTRACT

A method for providing an event message indicative of an imminent event for a vehicle. In a first step, a first event message and a second event message are initially received. The first event message represents a signal output by a first mobile terminal device in response to the imminent event; and the second event message represents a signal output by a second mobile terminal device in response to the imminent event. In a further step, an aggregated event message is generated on the basis of the first event message and the second event message. A step follows for ascertaining a plausibility value to check the plausibility of the aggregated event message. Finally, the aggregated event message and the plausibility value are output. The aggregated event message and the plausibility value represent a signal that is receivable from at least one mobile playback device.

15 Claims, 4 Drawing Sheets

(58) Field of Classification Search
USPC ..... 340/575
See application file for complete search history.

(56) References Cited

U.S. PATENT DOCUMENTS

2006/0258360 A1 11/2006 Smith
2007/0027583 A1* 2/2007 Tamir ..... G06Q 30/0283 701/1
2007/0168115 A1* 7/2007 Ikehara ..... G01C 21/3629 701/532
2007/0270120 A1* 11/2007 Zhang ..... G08G 1/087 455/344
2008/0071465 A1* 3/2008 Chapman ..... G01C 21/3691 701/117
2008/0091346 A1* 4/2008 Zerod ..... G01C 21/3691 701/423
2009/0109020 A1 4/2009 Tischer
2010/0250106 A1* 9/2010 Bai ..... G08G 1/096716 701/117
2011/0106736 A1* 5/2011 Aharonson ..... G06Q 10/109 706/12
2011/0241896 A1* 10/2011 Camino ..... G08B 3/10 340/691.5
2011/0267185 A1* 11/2011 Zhang ..... G07C 5/008 340/437
2012/0083220 A1* 4/2012 Rodermund ..... H04W 24/00 455/67.11
2013/0141251 A1* 6/2013 Sims ..... B60Q 9/008 340/905
2013/0154854 A1* 6/2013 Chen ..... G08G 1/096741 340/905
2013/0200223 A1* 8/2013 Alexander ..... B61L 29/28 246/473.1
2014/0066102 A1* 3/2014 Kuwahara ..... H04W 4/028 455/456.3
2016/0035311 A1* 2/2016 Ryo ..... H04M 1/7253 455/557
2016/0049149 A1* 2/2016 Lacher ..... B60K 37/06 704/9
2016/0101732 A1* 4/2016 Danz ..... B60Q 9/008 340/435
2016/0125675 A1* 5/2016 Ziller ..... B60R 25/24 340/5.72

* cited by examiner

METHOD AND DEVICE FOR PROVIDING AN EVENT MESSAGE INDICATIVE OF AN IMMINENT EVENT FOR A VEHICLE

BACKGROUND INFORMATION

The present invention relates to a method for providing an event message indicative of an imminent event for a vehicle, to a corresponding device, as well as to a corresponding computer program product.

Methods are available for providing an event message indicative of an imminent event for a vehicle, where information from sensors of the vehicle may be used to check the plausibility of the event message.

SUMMARY

The present invention provides a method for providing an event message indicative of an imminent event for a vehicle, a corresponding device, as well as, finally, a corresponding computer program product. Advantageous embodiments will become apparent from the description below.

In accordance with present approach, a mobile terminal device, such as a smart phone or a navigation system, may have sensors that are adapted for detecting an event, such as a road sign or a curve, that is imminent for a vehicle. The mobile terminal device may also be adapted for outputting a corresponding event message to a driver of the vehicle in response to a detection of the event. Before being output to the driver, the event message may be advantageously compared to other event messages about the event that are provided by other mobile terminal devices. For this purpose, the event message and the further event messages may be received and combined by a central evaluation device. The central evaluation device may also be adapted for assessing the plausibility of an event message combined in this manner. A corresponding plausibility value, as well as the combined event message may then be sent back to at least one mobile playback device, for example, the terminal device. The at least one playback device may be adapted as a function of an amount of the plausibility value, for example, to decide whether the combined event message is to be output to the driver or not. This makes it possible to significantly enhance a reliability with which an event message is provided by the terminal device.

A method is presented for providing an event message indicative of an imminent event for a vehicle, the method including the following steps:

receiving a first event message, the first event message representing a signal output by a first mobile terminal device of a first vehicle in response to the imminent event;

receiving a second event message or further event messages, the second event message representing a signal output by a second mobile terminal device of a second vehicle in response to the imminent event, or the further event messages representing signals output by other mobile terminal devices of other vehicles in response to the imminent event;

generating an aggregated event message on the basis of the first event message and the second event message or the further event messages;

ascertaining a plausibility value to check the plausibility of the aggregated event message; and outputting the aggregated event message and the plausibility value, the aggregated event message and the plausibility value representing a signal receivable from at least one mobile playback device of the vehicle.

An event that is imminent for a vehicle may be understood to be an event that requires increased attention from a driver of the vehicle. The event may be a road sign, a curve or a change in a road condition, for example. A vehicle may be understood to be a motor vehicle, such as an automobile, truck, bus or a motorcycle. A mobile terminal device may be understood to be a device that is adapted for detecting the event and, in response thereto, for outputting a corresponding event message. For example, the mobile terminal device may be a smart phone or a navigation system equipped with a camera or an acceleration sensor that is mounted in the vehicle. An event message may be a warning that is generated on the mobile terminal device in response to an imminent event. An aggregated event message may be understood to be an event message that results when at least two different event messages are combined using predetermined aggregation functions. A plausibility value may be understood to be a degree of correspondence of the aggregated event message to an actual event. A mobile playback device may be understood to be a mobile terminal device, such as a smart phone or a navigation system, that is adapted for receiving the plausibility value and the aggregated event message. As a function of an amount of the plausibility value, the mobile playback device may also be adapted for outputting the aggregated event message as an acoustic and/or optical warning to a user of the mobile playback device, for instance to the driver of the vehicle. The terminal device and the playback device may be one and the same device. A mobile playback device may also be understood to be a playback device that is installed in the vehicle—possibly having control functions as well, such as an enhanced ACC.

In place of the first and second exemplarily mentioned event messages, a plurality of event messages relating to an event may also be used. Thus, the described approach is not limited to the exemplarily mentioned event messages, rather may be expanded to include any desired number of event messages. It is, thus, possible to have a recursive expansion of the mentioned method steps with regard to further event messages.

Therefore, further event messages may be received in the receiving step, the further event messages representing signals output by other mobile terminal devices of other vehicles in response to the imminent event. Accordingly, the aggregated event message may be generated in the generating step on the basis of the first event message and the further event messages. It is, therefore, possible to execute the method not only with a potential minimum number of event messages, but also with any desired number of event messages.

In contrast to vehicle-mounted approaches, fewer sensors are available per device in the case of mobile terminal devices. The devices do not have any rain sensor or outside-temperature sensor, for example. In certain circumstances, the available sensor system may deviate in quality from vehicle-mounted sensors. Furthermore, a precise mounting position of the sensors, respectively of the mobile terminal device may be unknown. Therefore, in the case of one single event message, significantly less information may be known about ambient conditions, such as weather, the brightness related to time of day, the outside temperature or the mounting of the mobile terminal device. These and other ambient conditions may substantially influence the detection of an event. Thick fog or darkness may degrade the detection rates of optical sensors, for example.

One specific embodiment of the present approach advantageously provides for overcoming this lack of additional information by comparing an aggregated event message to aggregated event messages in a known vicinity of this aggregated event message. Here, the fact may be utilized that similar ambient conditions generally prevail in the known vicinity of an event message, as in the case of the event message itself.

The known limitations may be overcome by using a large number of distributed mobile terminal devices. In this case, each mobile terminal device transmits its data to a server. The individual messages are aggregated on this server to improve detection. A method for improving detection includes evaluating a vicinity relation. This method may be used, for example, to create a database that includes speed limits.

One specific embodiment of the present approach provides that a first event message from a first mobile terminal device be received in response to an event and that a second event message from a second mobile terminal device be received in response to the same event. The first and the second event message are combined in the generating step to form an aggregated event message.

Another specific embodiment of the present approach provides that a third and a fourth event message indicative of a further event be received in the receiving step. In this case, the third and fourth event message may each represent a signal output by a mobile terminal device in response to the further event. In addition, an aggregated further event message may be generated in the generating step on the basis of the third and fourth event message. Finally, in the determining step, the plausibility value may also be ascertained on the basis of the aggregated further event message. The further event may differ from the event in terms of a point in time and a location of the event.

Moreover, a fifth and a sixth event message indicative of an additional event may be received in the receiving step. In this case, the fifth and sixth event message may each represent a signal output by a mobile terminal device in response to the additional event. In addition, an aggregated additional event message may be generated in the generating step on the basis of the fifth and sixth event message. Finally, in the determining step, the plausibility value may also be ascertained on the basis of the aggregated additional event message. The additional event may differ from the event and the further event in terms of a point in time and a location of the event.

Another specific embodiment of the present approach provides that, in the receiving step, the third, fourth, fifth and/or sixth event message each be receivable as a signal output by the first or second mobile terminal device. In a determining step, a temporal and/or spatial relation may be determined in this case among the event, the further event and the additional event on the basis of the first, second, third, fourth, fifth and/or sixth event message. In the determining step, the plausibility value may also be ascertained on the basis of the temporal and/or spatial relation. On the basis of the temporal and/or spatial relation, it is possible ascertain whether the event, the further event, and the additional event are mutually proximate, i.e., whether the event messages were received under similar ambient conditions in the receiving step. This makes it possible to achieve a substantial accuracy of the method.

In the determining step, the further event may be defined as an event that precedes the event, and the additional event as an event that follows the event. This specific embodiment advantageously allows an especially efficient and resource-saving determination of the temporal and/or spatial relation.

Moreover, the method may include a step of combining event messages indicative of the event of preceding events with event messages indicative of the event of subsequent events to determine a maximum possible number of event messages indicative of the event. To ascertain the plausibility value, the maximum possible number may be compared here in the determining step with an actual number of event messages indicative of the event. This specific embodiment allows a very quick and accurate determination of the plausibility value.

Another specific embodiment of the present approach provides that an age of the actual number of event messages be additionally considered in the determining step in order to ascertain the plausibility value. Thus, an especially high level of reliability may be ensured when ascertaining the plausibility value.

To realize a system including a plurality of mobile terminal devices and at least one mobile playback device, the method may include a step of the first mobile terminal device outputting the first event message, and the second mobile terminal device outputting the second event message, and a step of the at least one mobile playback device receiving the aggregated event message and the plausibility value.

The present approach also provides a device for supplying an event message indicative of an imminent event for a vehicle, the device having the following features:

a receiving unit for receiving a first event message and a second event message, the first event message representing a signal output by a first mobile terminal device in response to the imminent event, and the second event message representing a signal output by a second mobile terminal device in response to the imminent event;

a generating unit for generating an aggregated event message on the basis of the first event message and the second event message;

a determining unit for ascertaining a plausibility value to check the plausibility of the aggregated event message; and an output unit for outputting the aggregated event message and the plausibility value, the aggregated event message and the plausibility value representing a signal receivable from at least one mobile playback device.

A device may be understood here to be an electrical device that processes sensor signals and outputs control and/or data signals as a function thereof. The device may have an interface implemented in hardware and/or software. When implemented in hardware, the interfaces may be part of what is commonly known as an ASIC system, for example, that includes a wide variety of functions of the device. However, the interfaces may also be separate integrated circuits or be at least partly composed of discrete components. When implemented in software, the interfaces may be software modules that are present on a microcontroller, for example, in addition to other software modules. This specific embodiment of the present approach makes it possible for the object underlying the approach to be achieved rapidly and efficiently.

Also advantageous is a computer program product having program code, that may be stored on a machine-readable medium, such as a semiconductor memory, a hard-disk memory or an optical memory, and that is used to implement the method in accordance with one of the specific embodiments described above when the program product is executed on a computer or a device.

The present invention is described in greater detail below with reference to the figures:

DETAILED DESCRIPTION OF EXAMPLE EMBODIMENTS

Figure 1A:
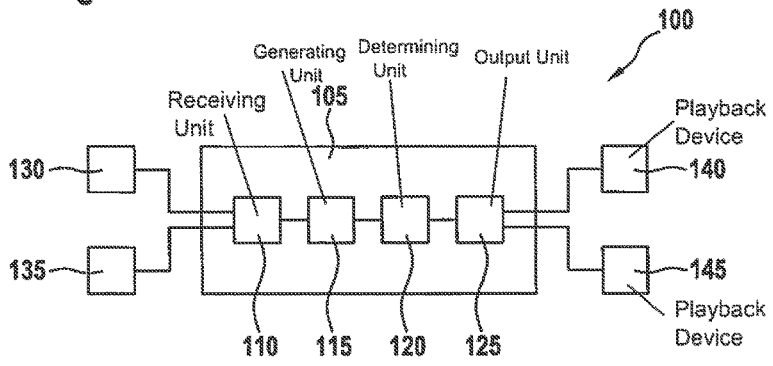
FIGS. 1*a* and 1*b* show schematic views of a system having a device for providing an event message in accordance with various exemplary embodiments of the present invention.

The following description of advantageous exemplary embodiments of the present invention employs the same or similar reference numerals for the elements that are shown in the various figures and whose function is similar, there being no need to repeat the description of these elements.

FIG. 1*a* shows a schematic view of a system 100 having a device 105 for providing an event message in accordance with an exemplary embodiment of the present invention. System 100 includes device 105. Device 105 includes a receiving unit 110 for receiving a first and a second event message, a generating unit 115 for generating an aggregated event message on the basis of the first and the second event message, a determining unit 120 for ascertaining a plausibility value to check the plausibility of the aggregated event message, as well as an output unit 125 for outputting the aggregated event message and the plausibility value.

System 100 also exemplarily includes a first mobile terminal device 130 and a second mobile terminal device 135. Terminal devices 130, 135 are each linked via an interface of device 105 to receiving unit 110. First terminal device 130 is adapted for outputting the first event message in response to an event that is imminent for a vehicle. Second terminal device 135 is adapted for outputting the second event message in response to the imminent event. First terminal device 130 is located in a first vehicle (not shown), and second terminal device 135 in a second vehicle (not shown), for example, the first event message being output when the first vehicle approaches the event, and the second event message being output when the second vehicle approaches the event.

Output unit 125 is exemplarily linked via a further interface of device 105 to a first mobile playback device 140 and a second mobile playback device 145. Playback devices 140, 145 are each adapted for receiving the aggregated event message and the plausibility value, and for initiating or suppressing a playback of the aggregated event message as a function of an amount of the plausibility value. First playback device 140 may be constituted here of first terminal device 130, and second playback device 145 of second terminal device 135. However, playback devices 140, 145 may also represent devices that differ from terminal devices 130, 135, and be located in other vehicles that are approaching the event, for example.

System 100 optionally includes a plurality of mobile terminal devices 130, 135, as well as a plurality of mobile playback devices 140, 145. Receiving unit 110 is adapted here for receiving a plurality of event messages indicative of a plurality of events. Using the plurality of event messages, generating unit 115 is adapted here for generating a plurality of aggregated event messages. Using the plurality of aggregated event messages, generating unit 120 is adapted here for generating a plurality of plausibility values. Finally, output unit 125 is adapted here for outputting the plurality of aggregated event messages and the plurality of plausibility values to the plurality of mobile playback devices 140, 145.

Figure 1B:
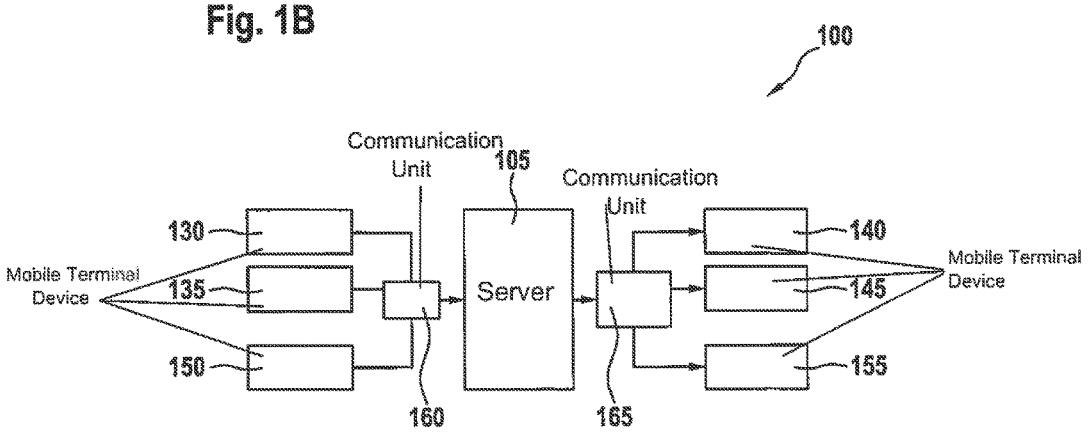

FIG. 1*b* shows system 100 including device 105 in accordance with another exemplary embodiment of the present invention. System 100 may also be referred to as system architecture 100; device 105 also as server system 105 or server 105. System 100 shown in FIG. 1*b* shows first mobile terminal device 130 as a detector, second mobile terminal device 135 as a detector, as well as an n-th mobile terminal device 150 as a detector. In addition, system 100 shows a first mobile terminal device 140 as an actuator, a second mobile terminal device 145 as an actuator, and an m-th mobile terminal device 155 as an actuator. Terminal devices 140, 145, 155 may also be referred to as playback devices 140, 145, 155.

There are m mobile terminal devices 130, 135, 150 that are used for collecting event messages, i.e., which act as detectors. There is also server system 105 upon which the event messages are aggregated and plausibility is checked. To collect the event messages, terminal devices 130, 135, 150 are adapted for communicating with a first communication unit 160. First communication unit 160 is adapted for outputting the event messages to server 105 for purposes of aggregation and a plausibility check.

In addition, there are n mobile terminal devices 140, 145, 155, which evaluate the aggregated event messages of server 105, together with the transmitted plausibility values, in some instances correlate them to their own event recognitions and, as the case may be, execute an action, i.e., act as actuators. To receive the aggregated event messages together with the plausibility values, terminal devices 140, 145, 155 are adapted for communicating with a second communication unit 165. Server 105 is adapted for outputting aggregated event messages, together with the plausibility values, to second communication unit 165.

Mobile terminal devices 130, 135, 150 are equipped with suitable sensors for detecting the events to be analyzed. For example, mobile terminal devices 130, 135, 150 are each designed with a camera system for detecting road signs or with acceleration sensors for detecting braking maneuvers or curves.

At the beginning of the use thereof, each mobile terminal device 130, 135, 150 generates a unique ID and transmits this unique ID, as well as time information, as part of all of the event messages thereof, until the end of a current use of mobile terminal device 130, 135, 150; i.e., a particular use of mobile terminal devices 130, 135, 150 may be differentiated by two different times of use, and a time characteristic analyzed within a use of mobile terminal devices 130, 135, 150.

Figure 2:
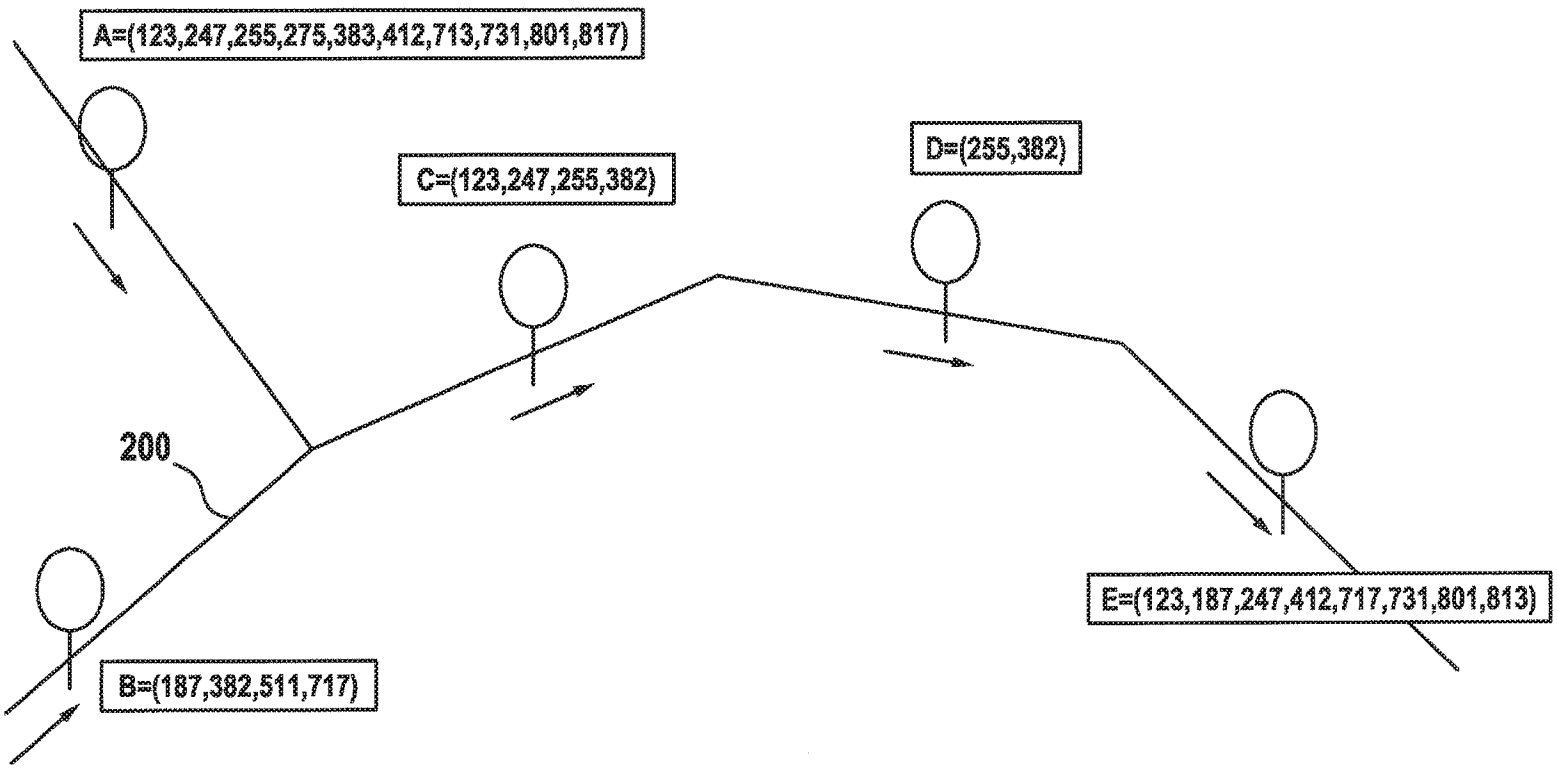
FIG. 2 shows a schematic view of a course of a road including different events for use in a method in accordance with an exemplary embodiment of the present invention.

FIG. 2 shows a schematic view of a course 200 of the road including different events for use in a method in accordance with an exemplary embodiment of the present invention. Five events in the form of road signs are sketched into course 200 of the road. The road signs are speed limits along course 200 of the road, for instance. One aggregated event message A, B, C, D or E each is assigned to the events. Aggregated event messages A, B, C, D, E are each represented as a set having at least two three-digit numbers as elements. Each number represents a use of a specific mobile terminal device that is located in a vehicle passing the road signs. For every use, i.e., for each passing of the vehicle by an event in the form of a road sign, an event message is generated, the event messages output by other mobile terminal devices are combined with regard to the event into an aggregated event message A, B, C, D, E. A particular sensing direction of the mobile terminal devices along course 200 of the road is indicated by arrows.

One exemplary embodiment of the present invention provides that a temporal and/or spatial relation be determined among aggregated event messages A, B, C, D, E on the basis of course 200 of the road. In this case, for example, aggregated event messages A, B are determined as event messages preceding aggregated event message C, and aggregated event messages D, E as event messages that follow aggregated event message C. A vicinity of aggregated event message C is determined as follows, for example.

For each unique use ID from aggregated event message C={123, 247, 255, 382}, the preceding aggregated event messages, that the mobile terminal device has passed, are determined. These are also referred to as predecessors. For example, as a predecessor, aggregated event message A is assigned to use IDs 123, 247, 255 from C, and, as a predecessor, aggregated event message B to use ID 382 from C. Analogously thereto, the subsequent aggregated event messages, also referred to as successors, are determined. For example, as a successor, aggregated event message D is assigned to use IDs 255, 382 from C, and, as a successor, aggregated event message E to use IDs 123, 247, 255 from C.

At this point, the union of sets of all unique use IDs for the predecessors is determined:

$A \cup B = \{123, 247, 255, 275, 383, 412, 713, 731, 801, 817\} \cup \{187, 382, 511, 717\}$
$= (123, 187, 247, 255, 275, 382, 383, 412, 511, 713, 717, 731, 801, 817)$ In the same way, the union of sets of the successors is determined:

$D \cup E = \{255, 382\} \cup \{123, 187, 247, 412, 717, 731, 801, 813\}$
$= (123, 187, 247, 255, 382, 412, 717, 731, 801, 813)$ In all likelihood, intersection C* of union of sets of the predecessors with the union of sets of the successors contains the pass-bys to be expected in aggregated event message C:

$C^* = (A \cup B) \cup (D \cup E) = \{123, 187, 247, 255, 382, 412, 717, 731, 801\}$ A comparison of C with C* reveals that, under similar ambient conditions, only four of nine pass-bys to be expected were detected.

In addition, with respect to C, it is a question of significantly older event messages than in the case of C* since, in this example, smaller IDs correspond to older information. In the context of the maximum size of the sets being limited, both for the expected pass-bys as well as for the transmitted event messages (in this example, maximally to the five most recent elements), this suggests that the aggregated event message C is too old and, therefore, only has a low plausibility.

One possible alternative is to evaluate a number of pass-bys of an aggregated event message during a specific time interval. In this approach, a ratio is established between a number of all individual event messages, that belong to the aggregated event message, and all passes by a position of the aggregated event message. This ratio may be utilized as a plausibility measure. In this alternative, ambient conditions should be modeled using an additional control system, the control system being able to reach a high level of complexity.

Figure 3:
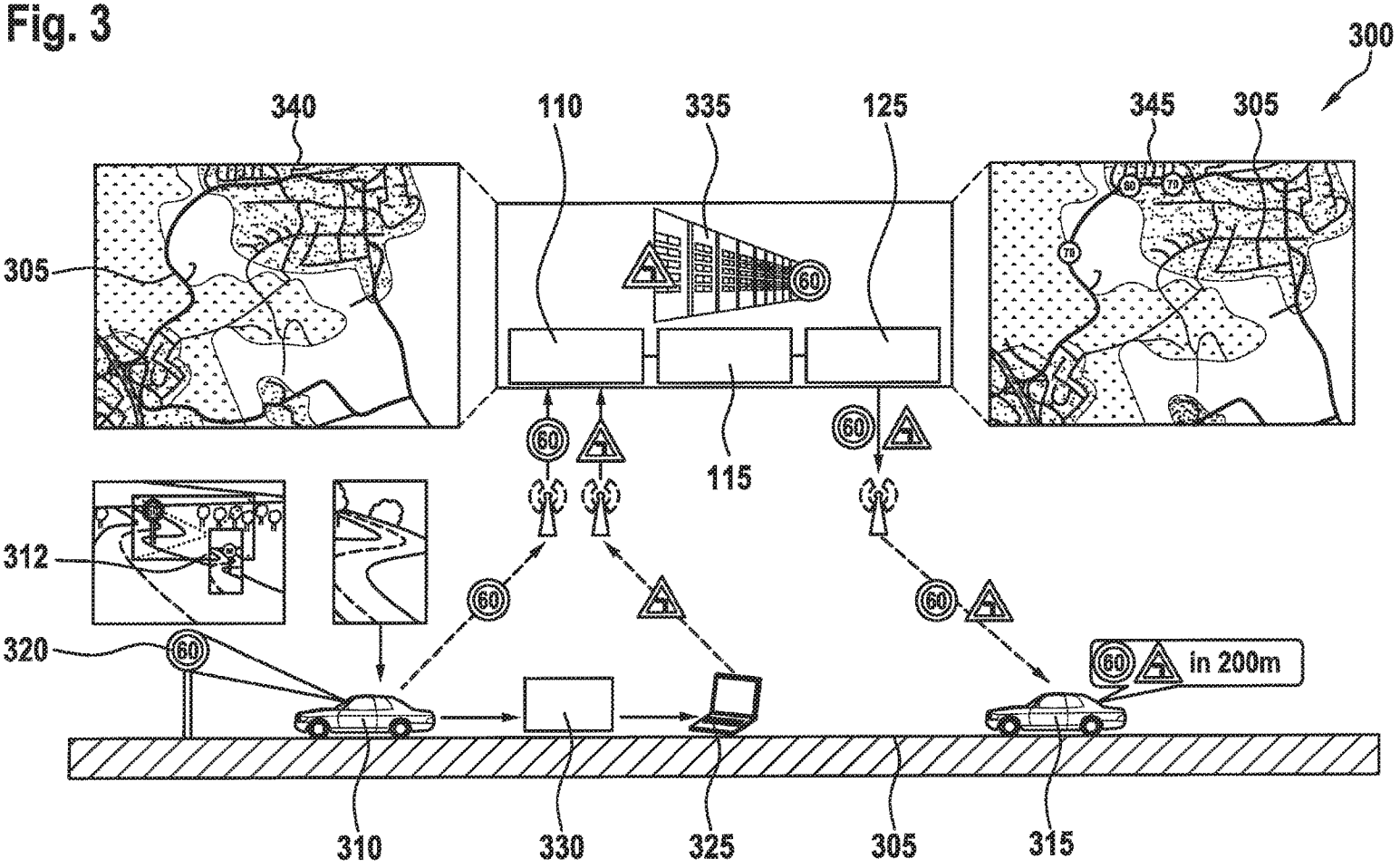
FIG. 3 shows a schematic view of an event detection situation in accordance with an exemplary embodiment of the present invention.

FIG. 3 shows a schematic view of an event detection situation 300 in accordance with an exemplary embodiment of the present invention. Event detection situation 300 encompasses a roadway 305, as well as a first vehicle 310 and a second vehicle 315. First vehicle 310 precedes second vehicle 315 by a distance of 200 meters, for example. In this case, first vehicle 310 moves toward a road sign 320 that specifies a permissible maximum speed of 60 km/h, for example.

A mobile terminal device 312 having an optical sensor is mounted on an instrument panel of first vehicle 310 in a way that allows the optical sensor to be directed at a near field in front of first vehicle 310, and a display screen of terminal device 312 to be visible to a driver of first vehicle 310. Terminal device 312 is adapted for sensing road sign 320 via the optical sensor, and for outputting a first event message indicative of an imminent speed limit.

Moreover, first vehicle 310 is equipped with a control unit 325. Control unit 325 and/or terminal device 312 are/is adapted for capturing a control angle of first vehicle 310 via a CAN bus 330 of first vehicle 310, and, using the control angle, for ascertaining an imminent change in a course of roadway 305, for instance a sharp curve. In addition, control unit 325 and/or mobile terminal device are/is adapted for outputting a second event message indicative of the imminent change in the course of the roadway. The event messages are output here via a wireless data connection, for example.

A central server 335 includes receiving unit 110, generating unit 115, the determining unit shown in FIG. 1A, as well as output unit 125. Receiving unit 110 may also be referred to as receiver, generating unit 115 as aggregator, and output unit 125 also as data/service provider. Receiving unit 110 is adapted for receiving the event messages via the wireless data connection. Using the event messages, generating unit 115 is adapted for generating an aggregated event message indicative of the imminent speed limit and the imminent change in the course of the roadway. Generating unit is adapted for determining a plausibility value for an aggregated event message. Output unit 125 is adapted for outputting the aggregated event message, for example, in the form of a corresponding radio signal.

Located in second vehicle 315 is a mobile playback device (not shown) that is adapted for receiving and processing the aggregated event message. A driver of second vehicle 315 may receive an acoustic and/or optical warning about the speed limit and curve to be expected in 200 meters via the playback device, for example.

In accordance with another exemplary embodiment, a digital road map 340 is stored on server 335. In this case, roadway 305 is part of road map 340. Using road map 340 and various aggregated event messages, central server 335 is adapted for generating an event message 345 that includes events, such as road signs or curves, that are to be expected along roadway 305. Event map 345 may be retrieved by mobile terminal devices that communicate with server 335 in order to play back corresponding event messages, provided that the terminal devices are moving within a geographic region covered by event map 345. Event map 345 may also be referred to as online ADAS map (ADAS=advanced driver assistance system).

Figure 4:
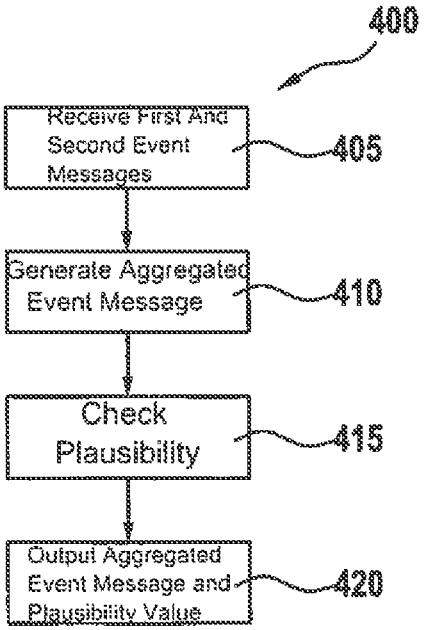
FIG. 4 shows a flow chart of a method for providing an event message in accordance with an exemplary embodiment of the present invention.

FIG. 4 shows a flow chart of a method 400 for providing an event message in accordance with an exemplary embodiment of the present invention. A step 405 for receiving a first event message and a second event message is initially implemented. In this case, the first event message represents a signal output by a first mobile terminal device in response to the imminent event, and the second event message represents a signal output by a second mobile terminal device in response to the imminent event. In a further step 410, an aggregated event message is generated on the basis of the first event message and the second event message. In a step 415, a plausibility value for checking the plausibility of the aggregated event message is subsequently ascertained. A step 420 ultimately follows for outputting the aggregated event message and the plausibility value. Here, the aggregated event message and the plausibility value represent a signal that is receivable from at least one mobile playback device.

An exemplary embodiment of the present invention relates to a method for checking the plausibility of event information on the basis of proximate event information of a plurality of distributed sensors, respectively of mobile terminal devices on a central server. The event information may also be referred to as event messages. The method also includes the aggregation of these event messages on the server system and providing the aggregated information on mobile terminal devices. Also provided are a comparison and thus an associated checking of the plausibility of data of an aggregated event message with data of event messages in a direct vicinity of this aggregated event message. The direct vicinity is defined here as a function of a motion path of the distributed mobile terminal devices and the events recognized by the mobile terminal devices prior and subsequent to the aggregated event message.

Figure 5:
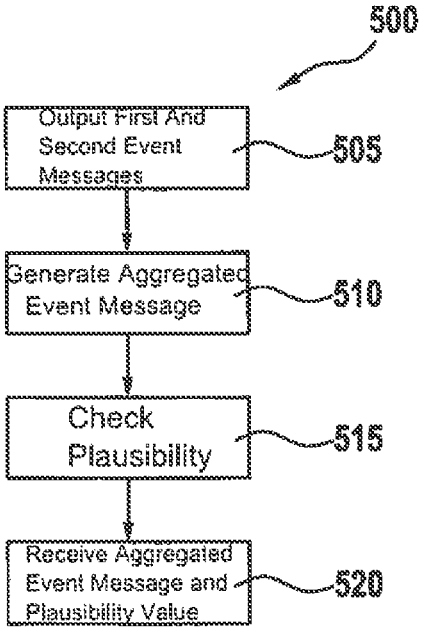
FIG. 5 shows a flowchart of a system method for providing an event message in accordance with an exemplary embodiment of the present invention.

FIG. 5 shows a flow chart of a system method 500 for providing an event message in accordance with an exemplary embodiment of the present invention. A step 505 is initially implemented for outputting a first event message by a first mobile terminal device, as well as a second event message by a second mobile terminal device, the outputting taking place in response to the imminent event. In a step 510, an aggregated event message is generated on the basis of the first event message and the second event message. A step 515 follows for ascertaining a plausibility value to check the plausibility of the aggregated event message. Finally, in a step 520, the aggregated event message and the plausibility value are received by at least one mobile playback device.

The described exemplary embodiments shown in the figures are only selected exemplarily. Various exemplary embodiments may be combined with one another entirely or by individual features. An exemplary embodiment may also be supplemented by features of another exemplary embodiment.

The example method steps may also be repeated and be executed in a sequence other than that described.

If an exemplary embodiment includes an "AND/OR" logic operation between a first feature and a second feature, then this is to be read as the exemplary embodiment in accordance with a specific embodiment having both the first feature, as well as the second feature and, in accordance with another specific embodiment, either only the first feature or only the second feature.

What is claimed is:

1. A method for providing an event message indicative of an imminent event for a vehicle, the method comprising:

receiving event messages indicative of at least one event preceding the imminent event, the event messages indicative of at least one event preceding the imminent event representing signals output by a first plurality of mobile terminals in response to the at least one event preceding the imminent event;

receiving event messages indicative of at least one event subsequent to the imminent event, the event messages indicative of at least one event subsequent to the imminent event representing signals output by a second plurality of mobile terminals in response to the at least one event subsequent to the imminent event;

receiving a first event message, the first event message representing a signal output by a first mobile terminal device of a first vehicle in response to the imminent event;

receiving a second event message, the second event message representing a signal output by a second mobile terminal device of a second vehicle in response to the imminent event;

generating an aggregated event message on the basis of the first event message and the second event message;

combining the received event messages indicative of at least one event preceding the imminent event with the received event messages indicative of at least one event subsequent to the imminent event to determine a maximum possible count of event messages indicative of the imminent event;

ascertaining a plausibility value to check the plausibility of the aggregated event message, the ascertaining including comparing the maximum possible count of event messages to an actual count of event messages indicative of the imminent event, the plausibility value being ascertained based on the result of the comparing; and outputting the aggregated event message and the plausibility value, the aggregated event message and the plausibility value representing a signal receivable from at least one mobile playback device of the vehicle.

2. The method as recited in claim 1, wherein a third event message and a fourth event message indicative of one of the at least one event preceding the imminent event are received in a receiving step, the third event message and the fourth event message each representing a signal output by a mobile terminal device in response to the one of the at least one event preceding the imminent event; an aggregated further event message is generated in the generating step on the basis of the third event message and the fourth event message; and in the ascertaining step, the plausibility value also being ascertained on the basis of the aggregated additional event message.

3. The method as recited in claim 2, wherein:

a fifth event message and a sixth event message indicative of one of the at least one event subsequent to the imminent event are received in the receiving step, the fifth event message and the sixth event message each representing a signal output by a mobile terminal device in response to the one of the at least one event subsequent to the imminent event;

an aggregated additional event message is generated in the generating step on the basis of the fifth event message and the sixth event message; and in the ascertaining step, the plausibility value also being ascertained on the basis of the aggregated additional event message.

4. The method as recited in claim 3, wherein:

at least one of the third event message, the fourth event message, the fifth event message, and the sixth event message, are received as a signal output by the first mobile terminal device or the second mobile terminal device;

in a ascertaining step, at least one of a temporal and spatial relation being determined among the imminent event, the one of the at least one event preceding the imminent event and the one of the at least one event subsequent to the imminent event on the basis of at least one of the first event message, the second event message, the third event message, the fourth event message, the fifth event message, and the sixth event message; and in the ascertaining step, the plausibility value also being ascertained on the basis of the at least one of temporal and spatial relation.

5. The method as recited in claim 1, wherein in the determining step, an age of the actual number of event messages is additionally considered in order to ascertain the plausibility value.

6. The method as recited in claim 1, wherein the first mobile terminal device outputs the first event message, and the second mobile terminal device outputs the second event message, and at least one mobile playback device receives the aggregated event message and the plausibility value.

7. The method as recited in claim 1, wherein further event messages are received in the receiving step, the further event messages representing signals output by other mobile terminal devices of other vehicles in response to the imminent event, and in the generating step, the aggregated event message being generated on the basis of the first event message and the further event messages.

8. A device for providing an event message indicative of an imminent event for a vehicle, the device comprising:

a receiving unit to: (i) receive event messages indicative of at least one event preceding the imminent event, the event messages indicative of at least one event preceding the imminent event representing signals output by a first plurality of mobile terminals in response to the at least one event preceding the imminent event, (ii) receive event messages indicative of at least one event subsequent to the imminent event, the event messages indicative of at least one event subsequent to the imminent event representing signals output by a second plurality of mobile terminals in response to the at least one event subsequent to the imminent event, and (iii) receive a first event message and a second event message, the first event message representing a signal output by a first mobile terminal device of a first vehicle in response to the imminent event, and the second event message representing a signal output by a second mobile terminal device of a second vehicle in response to the imminent event;

a generating unit to generate an aggregated event message on the basis of the first event message and the second event message;

a determining unit to ascertain a plausibility value to check plausibility of the aggregated event message; and an output unit to output the aggregated event message and the plausibility value, the aggregated event message and the plausibility value representing a signal receivable from at least one mobile playback device of the vehicle;

wherein the device is further configured to combine the received event messages indicative of at least one event preceding the imminent event with the received event messages indicative of at least one event subsequent to the imminent event to determine a maximum possible count of event messages indicative of the imminent event, and wherein the ascertainment of the plausibility value by the determining unit includes comparing the maximum possible count of event messages to an actual count of event messages indicative of the imminent event, the plausibility value being ascertained based on the result of the comparing.

9. A non-transitory machine-readable storage medium storing program code for providing an event message indicative of an imminent event for a vehicle, the program code, when executed by a computer, causing the computer to perform:

receiving event messages indicative of at least one event preceding the imminent event, the event messages indicative of at least one event preceding the imminent event representing signals output by a first plurality of mobile terminals in response to the at least one event preceding the imminent event;

receiving event messages indicative of at least one event subsequent to the imminent event, the event messages indicative of at least one event subsequent to the imminent event representing signals output by a second plurality of mobile terminals in response to the at least one event subsequent to the imminent event;

receiving a first event message, the first event message representing a signal output by a first mobile terminal device of a first vehicle in response to the imminent event;

receiving a second event message, the second event message representing a signal output by a second mobile terminal device of a second vehicle in response to the imminent event;

generating an aggregated event message on the basis of the first event message and the second event message;

combining the received event messages indicative of at least one event preceding the imminent event with the received event messages indicative of at least one event subsequent to the imminent event to determine a maximum possible count of event messages indicative of the imminent event;

ascertaining a plausibility value to check the plausibility of the aggregated event message, the ascertaining including comparing the maximum possible count of event messages to an actual count of event messages indicative of the imminent event, the plausibility value being ascertained based on the result of the comparing; and outputting the aggregated event message and the plausibility value, the aggregated event message and the plausibility value representing a signal receivable from at least one mobile playback device of the vehicle.

10. The method as recited in claim 1, wherein each of the received event messages indicative of at least one event preceding the imminent event, and the received of event messages indicative of at least one event subsequent to the imminent event is associated with an identification of a specific mobile terminal.

11. The method as recited in claim 10, wherein:

the combining includes:

determining a first set of event messages, the first set of event messages including the received event messages indicative of at least one event preceding the imminent event;

determining a second set of event messages, the second set of event messages including the received event messages indicative of at least one event subsequent to the imminent event; and determining a third set of event messages, the third set of event messages being an intersection of the first set of event message and the second set of event messages, the intersection being based on the identifications of the specific mobile terminal associated with the event messages indicative of at least one event preceding the imminent event and the event messages indicative of at least one event subsequent to the imminent event; and the maximum possible count of event messages is a count of event messages in the third set of event messages.

12. The device as recited in claim 8, wherein each of the received event messages indicative of at least one event preceding the imminent event, and the received of event messages indicative of at least one event subsequent to the imminent event is associated with an identification of a specific mobile terminal.

13. The device as recited in claim 12, wherein:

the device is configured to perform the combining by:

determining a first set of event messages, the first set of event messages including the received event messages indicative of at least one event preceding the imminent event;

determining a second set of event messages, the second set of event messages including the received event messages indicative of at least one event subsequent to the imminent event; and determining a third set of event messages, the third set of event messages being an intersection of the first set of event message and the second set of event messages, the intersection being based on the identifications of the specific mobile terminal associated with the event messages indicative of at least one event preceding the imminent event and the event messages indicative of at least one event subsequent to the imminent event; and the maximum possible count of event messages is a count of event messages in the third set of event messages.

14. The non-transitory machine-readable storage medium as recited in claim 9, wherein each of the event messages indicative of at least one event preceding the imminent event, and the of event messages indicative of at least one event subsequent to the imminent event is associated with an identification of a specific mobile terminal.

15. The non-transitory machine-readable storage medium as recited in claim 14, wherein:

the combining includes:

determining a first set of event messages, the first set of event messages including the received event messages indicative of at least one event preceding the imminent event;

determining a second set of event messages, the second set of event messages including the received event messages indicative of at least one event subsequent to the imminent event; and determining a third set of event messages, the third set of event messages being an intersection of the first set of event message and the second set of event messages, the intersection being based on the identifications of the specific mobile terminal associated with the event messages indicative of at least one event preceding the imminent event and the event messages indicative of at least one event subsequent to the imminent event; and the maximum possible count of event messages is a count of event messages in the third set of event messages.

* * * * *